United States Patent [19]

Ishii et al.

[11] Patent Number: 4,653,165

[45] Date of Patent: Mar. 31, 1987

[54] METHOD FOR MAKING A POLY-V GROOVED PULLEY WITH INTERIOR RIBS

[75] Inventors: Masami Ishii; Hiroshi Motoyama; Ryohei Yabuno; Akihito Isomura, all of Toyota, Japan

[73] Assignee: Aisin Seiki Kabushiki Kaisha, Kariya, Japan

[21] Appl. No.: 708,383

[22] Filed: Mar. 8, 1985

Related U.S. Application Data

[63] Continuation of Ser. No. 463,718, Feb. 4, 1983, abandoned.

[30] Foreign Application Priority Data

Feb. 24, 1982 [JP] Japan ..... 57-29187

[51] Int. Cl.[4] ..... E21K 1/42

[52] U.S. Cl. ..... 29/159 R; 474/170

[58] Field of Search ..... 29/159 R, 159.2; 72/105, 370; 474/168, 170

[56] References Cited

U.S. PATENT DOCUMENTS

| | | | |
|---|---|---|---|
| 2,200,245 | 5/1940 | Schultz, Jr. | 29/159 R |
| 3,407,638 | 10/1968 | Greis et al. | 72/105 |
| 3,772,928 | 11/1973 | Gobeille | 474/170 |
| 3,977,264 | 8/1976 | Sproul | 474/170 |
| 4,098,137 | 4/1978 | Yaros | 474/170 |
| 4,197,756 | 4/1980 | Yaros | 474/170 |
| 4,313,323 | 2/1982 | Kanemitsu | 72/84 |
| 4,487,048 | 12/1984 | Frei | 72/105 |

*Primary Examiner*—Percy W. Echols

*Attorney, Agent, or Firm*—Oblon, Fisher, Spivak, McClelland & Maier

[57] ABSTRACT

An inner surface of a cylindrical flange wall of a poly-V pulley is provided with a plurality of ribs in the longitudinal or axial direction of the cylindrical flange wall for strengthing the cylindrical flange wall.

9 Claims, 19 Drawing Figures

METHOD FOR MAKING A POLY-V GROOVED PULLEY WITH INTERIOR RIBS

This application is a continuation of application Ser. No. 463,718, filed Feb. 4, 1983 now abandoned.

BACKGROUND OF THE INVENTION

1. Field of the Invention

This invention relates to a poly-V grooved pulley, and more particularly to a poly-V grooved pulley with ribs as well as a method of making the same.

2. Description of the Prior Art

There has been previously employed a poly-V grooved pulley of sheet metal for use with a poly-V belt in a driving system of a vehicle. In a conventional poly-V grooved pulley disclosed in U.S. Pat. No. 3,977,264, for example, a cylindrical flange wall on which a plurality of V-grooves are formed is terminated in an outturned flange so as to strengthen the flange wall. However, such a pulley is comparatively or relatively heavy in weight with the result that torque may not be transmitted efficiently.

SUMMARY OF THE INVENTION

It is, therefore, a primary object of this invention to provide a lighter poly-V grooved pulley in comparison with the conventional pulley, without decreasing the strength of the flange wall.

Another object of this invention is to provide a poly-V grooved pulley provided at an inner surface of a flange wall thereof with a plurality of ribs in the longitudinal or axial direction of the flange wall.

In accordance with the present invention, a flange wall of a poly-V pulley may be strengthened or become stronger without increasing the thickness of the flange wall due to the existence of the plural ribs provided thereto. Thus, high torque may be transmitted with efficiency, thinner metal may be employed for forming the pulley with the result that the newly formed pulley may be decreased in weight, and a broad belt or two or three narrow belts operatively connected to different devices may be mounted on the pulley.

DETAILED DESCRIPTION OF THE PREFERRED EMBODIMENTS

Figure 1:
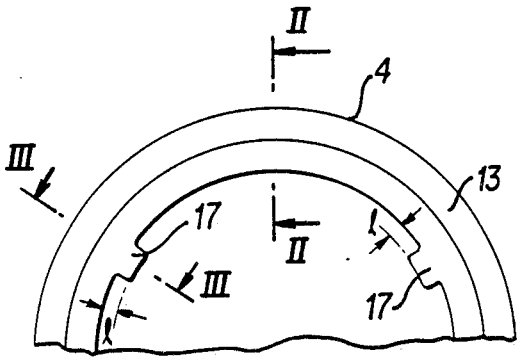
FIG. 1 is a fragmentary side view of a poly-V grooved pulley.
Figure 2:
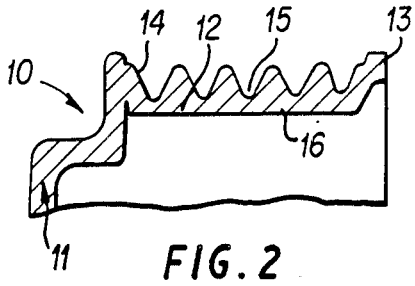
FIG. 2 is a cross sectional view along II—II line of FIG. 1.
Figure 3:
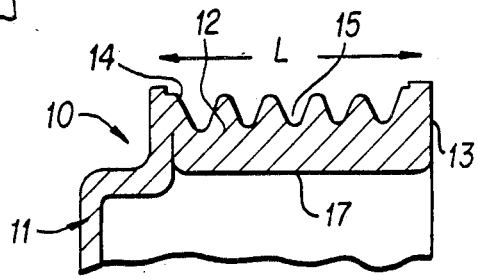
FIG. 3 is a cross sectional view along III—III line of FIG. 1.

Referring now to FIGS. 1 through 3, a poly-V grooved pulley 10 has a hub wall 11 and a cylindrical flange wall 12 terminated at a distal end 13. The hub wall 11 is formed with the cylindrical flange wall 12. The cylindrical flange wall 12 is provided at an outer surface 14 with a plurality of V-shaped grooves 15. The cylindrical flange wall 12 is provided at an inner surface 16 thereof with a plurality of ribs 17. Each of the ribs 17 is projected from the inner surface 16 at a height 1 and is elongated along the inner surface 16 by a length L in the longitudinal or axial direction of the inner surface 16.

In FIGS. 4 through 7, there is illustrated a method of making the aforementioned poly-V grooved pulley 10 in detail. A source member 20 for the pulley 10 is formed in a substantially cup-shaped configuration from a single metal sheet through a process which is described in the U.S. Patent application filed on June 9, 1982 and having the Ser. No. 386,528, now U.S. Pat. No. 4,468,772 . The member 20 includes a hub wall 21 and a cylindrical flange wall 22 integrally formed therewith, both of which respectively correspond to the hub wall 11 and the cylindrical flange wall 12.

Above the cylindrical flange wall 22 is located or positioned a spinning roller 30 having a plurality of cutting edges 31 in opposition to an outer surface 23 of the cylindrical flange wall 22. Within the cylindrical flange wall 22, there is loosely installed a mandrel 35 divided into four segments 35*a*, 35*b*, 35*c* and 35*d* (only 35*d* is not shown) in the circumferential direction. An annular groove 36 is provided in a side facing the hub wall 21 of the source member 20 and is divided into four sections 36*a*, 36*b*, 36*c* and 36*d* all of which respectively correspond to the segments 35*a*, 35*b*, 35*c* and 35*d*. An annular ring 37 is fitted in the groove 36 so as to reduce the radius of the mandrel 35 or to form a clearance 38 between an inner surface 24 of the cylindrical flange wall 22 and an outer surface 39 of the mandrel 35.

Figure 4:
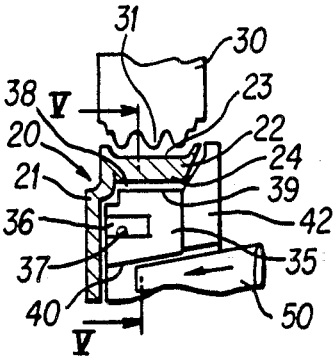
FIG. 4 is a fragmentary cross sectional view showing the condition before forming the V-shaped grooves.
Figure 5:
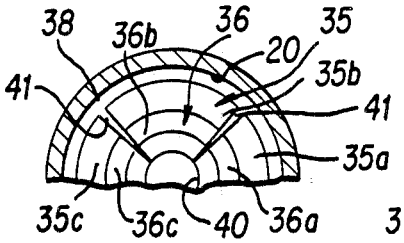
FIG. 5 is a left side view of FIG. 4.

The mandrel 35 is also provided at a center portion thereof with a tapered bore 40 whose diameter gradually increases in the rightward direction as seen in FIG. 4. Between any two adjacent segments of the mandrel 35, there is formed a radial clearance 41 (FIG. 5). A member 42 is located at a right side of the mandrel 35 and the source member 20.

In operation, when the rotating roller 30 is brought into engagement with an outer surface 23 of the source member, V-shaped grooves are formed. Simultaneously with the above, when a tapered bar 50 is fitted in the tapered bore 40 of the mandrel 35, the mandrel 35 is expanded in the radial direction with the result that the outer surface 39 of the mandrel 35 is brought into abutment with the inner surface 24 of the source member 20, and clearances 41 between any two adjacent segments of the mandrel 35 are expanded in the circumferential direction. Thus, by further expansion of the mandrel ribs 17 are projected or extended from the inner surface 24 of the member 20 into the expanded width clearances 41.

Figure 9:
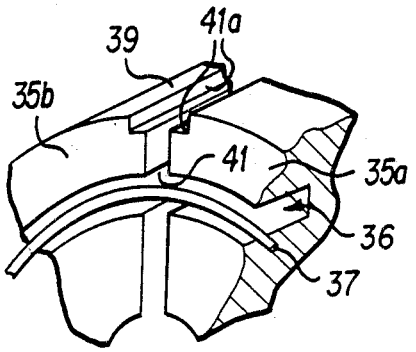
FIG. 9 is a fragmentary perspective view of a mandrel for changing the cross-sectional shape of the ribs.
Figure 8:
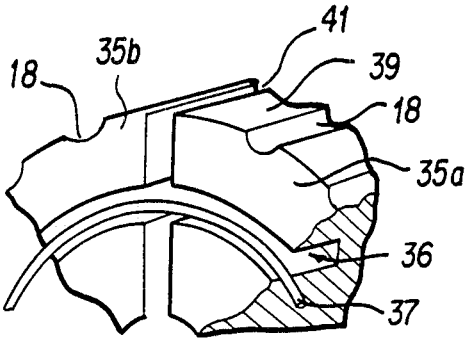
FIG. 8 is a fragmentary perspective view of a mandrel for increasing the number of the ribs.
Figure 10:
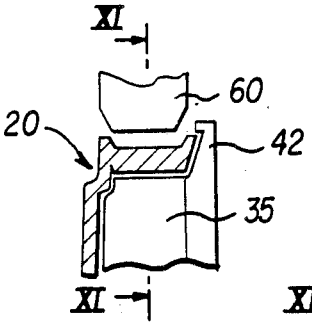
FIGS. 10 through 13 are views showing a process of making the ribs before forming the V-shaped grooves.
Figure 11:
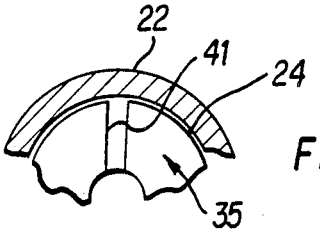
Figure 12:
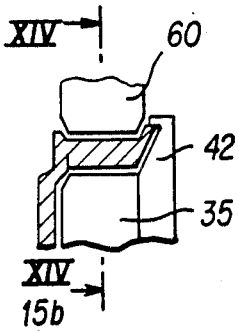
Figure 13:
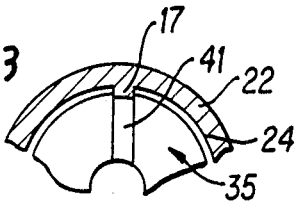

As seen from FIG. 8, further ribs (not shown) may be formed in addition to the ribs 17 by providing cutout portions 18 on the outer surface 39 of the mandrel 35. Each of the ribs 17 may be changed in shape by expanding an opening of the clearance 41 due to a pair of opposed longitudinally half-rectangular notches 41*a* on the adjacent segments 35*a* and 35*b* (FIG. 9).

Figure 14:
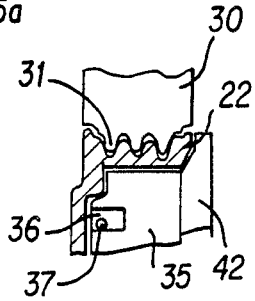
FIG. 14 is a view showing a process of making the ribs after forming V-shaped grooves.
Figure 6:
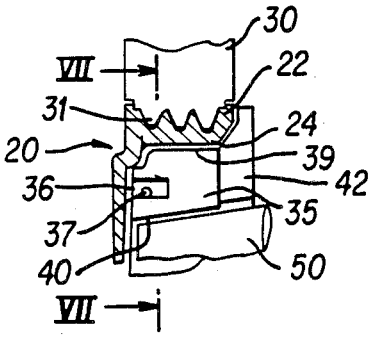
FIG. 6 is a fragmentary cross sectional view showing the condition upon forming the V-shaped grooves.
Figure 7:
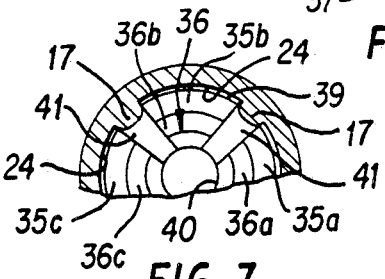
FIG. 7 is a side view of FIG. 6.

The ribs 17 may be formed prior to V-grooves formation by using expandable mandrels 35, a roller 60, and the member 42, as seen from FIGS. 10 through 13. On the contrary, the ribs 17 may be formed after forming of V-grooves as seen from FIG. 14 wherein the mandrel 35 is expanded with the roller 30 resting on the flange wall 22. In each case the roller 30 is used for forming the V-shaped grooves.

Figure 17:
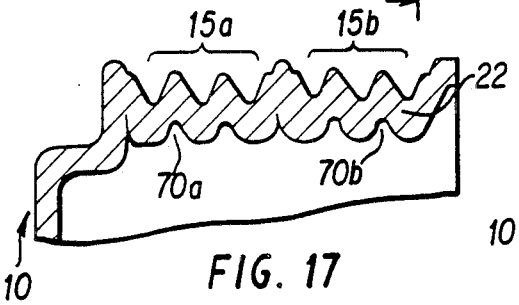
FIG. 17 is a fragmentary cross sectional view of still another pulley to be provided ribs.
Figure 15:
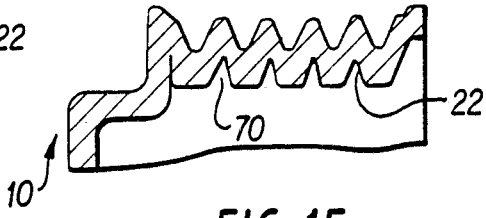
FIG. 15 is a fragmantary cross sectional view of another pulley to be provided ribs.
Figure 18:
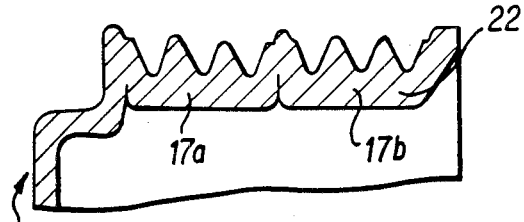
FIG. 18 is a fragmentary cross sectional view of the pulley of FIG. 17 after being provided with ribs.
Figure 16:
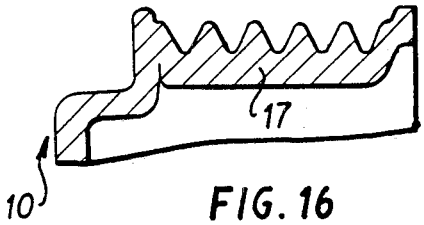
FIG. 16 is a frgmentary cross sectional view of the pulley of FIG. 15 after being provided with ribs.

The ribs 17 also may be formed on an inner surface 22 extending transversely of plural V-shaped grooves 70 for reducing weight of the pulley 10 as seen from FIGS. 15 and 16. In the case that two sets of plural V-shaped grooves 15*a* and 15*b* are formed on the outer surface 24 of the flange wall 22 as well as corresponding sets of inner plural grooves 70*a* and 70*b* being formed on the inner surface 24, each of the ribs 17 is divided into two portions 17*a* and 17*b* as shown in FIGS. 17 and 18.

What is claimed is:

1. A method of manufacturing a poly-V grooved pulley so as to integrally form a plurality of ribs on an inner surface of a cylindrical flange wall of the poly-V grooved pulley for strengthening the cylindrical flange wall, said method comprising the steps of:

forming a substantially cup-shaped source member from a single metal sheet, said source member having a hub wall and a cylindrical flange integrally formed with said hub wall;

positioning a plurality of cutting edges of a roller adjacent to an outer surface of said cylindrical flange wall;

loosely installing within said flange wall a mandrel divided in the circumferential direction into a plurality of segments;

engaging said cutting edges of said rotating roller with said outer surface of said cylindrical flange wall; and simultaneously with said step of engaging, expanding said segments of said mandrel in the radial direction so as to abut an outer surface of said mandrel with an inner surface of said cylindrical flange wall and form said ribs by pressing against said flange wall while expanding a clearance between any two adjacent ones of said segments of said mandrel.

2. A method of manufacturing as set forth in claim 1, wherein said mandrel installing step comprises installing a mandrel having a tapered bore for fitting a tapered bar thereinto at a center portion thereof.

3. A method of manufacturing as set forth in claim 1, wherein said mandrel installing step comprises installing a mandrel having an annular groove for fitting an annular ring thereinto so as to form a clearance between said inner surface of said cylindrical flange wall and said outer surface of said mandrel.

4. A method of manufacturing a poly-V grooved pulley so as to integrally form a pluality of ribs on an inner surface of a cylindrical flange wall of the poly-V grooved pulley for strengthening the cylindrical flange wall, said method comprising the steps of:

forming a substantially cup-shaped source member from a single metal sheet, said source member having a hub wall and a cylindrical flange wall integrally formed with said hub wall;

positioning a first roller adjacent an outer surface of said cylindrical flange wall;

loosely installing within said flange wall a mandrel divided in the circumferential direction into a plurality of segments;

expanding said segments of said mandrel in the radial direction so as to abut and press an outer surface of said mandrel with an inner surface of said cylindrical flange wall in cooperation with expanding a clearance between any adjacent segments of said mandrel by a degree sufficient for forming said ribs; and engaging a plurality of cutting edges of a second roller with said outer surface of said cylindrical flange wall while engaging said segments with said inner surface of said cylindrical flange wall to form said V-shaped grooves.

5. A method of manufacturing as set forth in claim 4, wherein said mandrel installing step comprises installing a mandrel having a tapered bore for fitting a tapered bar thereinto at a center portion thereof.

6. A method of manufacturing as set forth in claim 4, wherein said mandrel installing step comprises installing a mandrel having an annular groove for fitting an annular ring thereinto so as to form a clearance between said inner surface of said cylindrical flange wall and said outer surface of said mandrel.

7. A method of manufacturing a poly-V grooved pulley so as to integrally form a plurality of ribs on an inner surface of a cylindrical flange wall of the poly-V grooved pulley for strengthening the cylindrical flange wall, said method comprising the steps of:

forming a substantially cup-shaped source member from a single metal sheet, said source member having a hub wall and a cylindrical flange integrally formed with said hub wall;

using a plurality of cutting edges of a roller to form a plurality of V-shaped grooves on an outer surface of said cylindrical flange wall;

loosely installing within said flange wall a mandrel divided in the circumferential direction into a plurality of segments; and expanding said segments of said mandrel in the radial direction so as to abut and press an outer surface of said mandrel with an inner surface of said cylindrical flange wall in cooperation with expanding a clearance between any adjacent segments of said mandrel by a degree sufficient for forming said ribs while said roller remains at rest on said cylindrical flange wall.

8. A method of manufacturing as set forth in claim 7, wherein said mandrel installing step comprises installing a mandrel having a tapered bore for fitting a tapered bar thereinto at a center portion thereof.

9. A method of manufacturing as set forth in claim 7, wherein said mandrel installing step comprises installing a mandrel having an annular groove for fitting an annular ring thereinto so as to form a clearance between said inner surface of said cylindrical flange wall and said outer surface of said mandrel.

* * * * *